US005704816A

United States Patent [19]

Polidori

[11] Patent Number: 5,704,816

[45] Date of Patent: Jan. 6, 1998

[54] HINGED ELECTRICAL CONNECTOR

[75] Inventor: Mario Polidori, Medford Lakes, N.J.

[73] Assignee: Thomas P. Polidori, Medford, N.J.

[21] Appl. No.: 560,970

[22] Filed: Nov. 20, 1995

[51] Int. Cl.[6] ..... H01R 4/44

[52] U.S. Cl. ..... 439/781; 403/391

[58] Field of Search ..... 439/746, 781, 439/782; 403/391

[56] References Cited

U.S. PATENT DOCUMENTS

| | | | |
|---|---|---|---|
| 953,934 | 4/1910 | Vogel | 439/782 |
| 1,420,790 | 6/1922 | Varney | 439/781 |
| 2,712,167 | 7/1955 | Blanchard | 439/781 |
| 2,791,623 | 5/1957 | Lock et al. | 439/781 |
| 2,858,520 | 10/1958 | Chance | 439/781 |
| 3,115,540 | 12/1963 | Greer | 403/391 |
| 3,177,459 | 4/1965 | Toedtman | 439/781 |
| 3,470,526 | 9/1969 | Joly | 439/781 |
| 3,553,351 | 1/1971 | Lindsey | 403/391 |
| 3,892,455 | 7/1975 | Sotolongo | 439/781 |
| 4,707,051 | 11/1987 | Hall | 439/781 |
| 4,723,920 | 2/1988 | Werner | 439/782 |
| 4,734,062 | 3/1988 | Goto | 439/783 |
| 4,858,092 | 8/1989 | Lu | 439/781 |
| 5,342,224 | 8/1994 | Lefavour | 439/781 |

*Primary Examiner*—Neil Abrams
*Attorney, Agent, or Firm*—Norman E. Lehrer

[57] ABSTRACT

An electrical connector includes a first jaw member 12 that has an inside surface, an outside surface, a first end 16 and a second end 18. The first jaw member further has a curved portion 24 formed on the inside surface adjacent the first end and a plurality of spaced apart pairs of fingers 28, 30 and 32 extending inwardly from the second end. A second jaw member 14 has an inside surface, an outside surface, a first end 20 and a second end 22. The second jaw member also has a curved portion 26 formed on the inside surface adjacent the first end and spaced apart finger pairs 36 and 38 extending inwardly from the second end. A terminal in the form of a stirrup 40 is secured between the second ends of the first and second jaw members. The stirrup has a gap 50 formed therethrough. Projecting from the second end of the first jaw member is a stop member 34. The stop member is positioned between the gap in the stirrup in order to prevent axial movement of the same along the electrical connector. The free ends of the finger pairs are swaged about a portion of the stirrup 40.

10 Claims, 2 Drawing Sheets

HINGED ELECTRICAL CONNECTOR

BACKGROUND OF THE INVENTION

The present invention is directed toward a hinged electrical connector and, more particularly, to such a connector that is secured to a high tension wire to provide a terminal so that energy from the wire can be directed to an electrical device.

Oftentimes it is necessary to tap electricity off a high tension wire and direct it to an electrical device such as a transformer. In order to tap the electricity, a connector must be utilized between the high tension wire and one end of a conductive cable. Different size connectors must, of course, be utilized for different sized high tension wires. As a result, a workman must either climb a utility pole or utilize a "cherry picker" or other mechanical lifting mechanism in order to get close enough to the high tension line to secure the connector thereto. This obviously creates significant danger.

In lieu of connecting a conductive cable directly to the high tension line, devices have been employed which include a connector and a terminal and wherein the terminal can then be utilized to provide electrical current to the electrical device to be energized. Frequently, such terminals are in the shape of a stirrup which presents a convenient terminal of uniform size that can be easily utilized by a workman. Another connector secured to the end of the cable can then be used to connect the cable to the high tension line through the stirrup. Since the stirrup is of uniform size, the connectors can be pre-selected and be of the type that are capable of being connected to the stirrup from a distance utilizing an extension pole or the like. When utilizing these combined connectors and stirrups, it is important that the electrical connector be easily and firmly secured to the high tension wire and that the stirrup be held securely in place.

SUMMARY OF THE INVENTION

It is an object of the present invention to provide an electrical connector that can be readily and firmly secured to a high tension wire.

It is another object of the invention to provide such a connector that furnishes a terminal in order to facilitate the transfer of energy from the high tension wire to an electrical device.

In accordance with the illustrative embodiments, demonstrating features and advantages of the present invention, there is provided a hinged electrical connector which includes a first jaw member that has an inside surface, an outside surface, a first end and a second end. The first jaw member has a curved portion formed on the inside surface adjacent the first end. A second jaw member has an inside surface, an outside surface, a first end and a second end. The second jaw member also has a curved portion formed on the inside surface adjacent the first end. A terminal in the form of a stirrup is secured between the second ends of the first and second jaw members. The stirrup has a gap formed therethrough. Projecting from the second end of the first jaw member is a stop member. The stop member is positioned between the gap in the stirrup in order to prevent axial movement of the same along the electrical connector.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
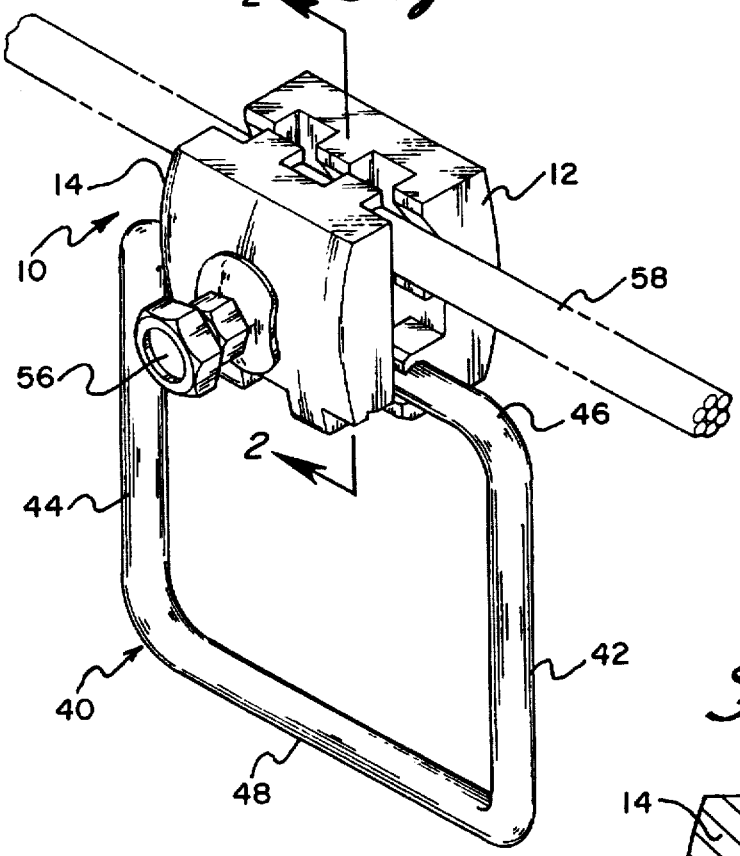
FIG. 1 is a perspective view of the present invention.
Figure 2:
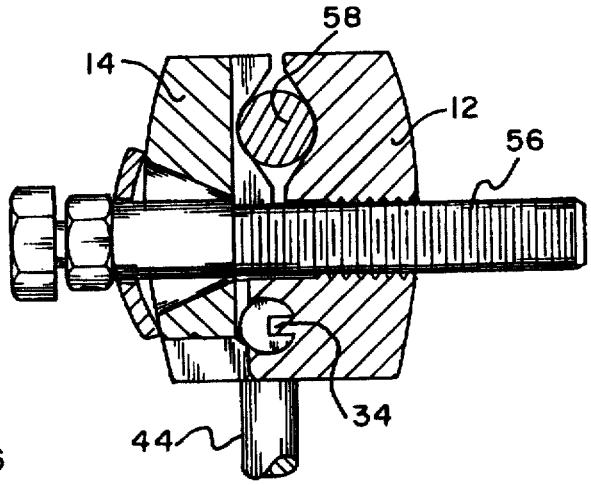
FIG. 2 is a side cross-sectional view taken along the lines 2—2 of FIG. 1.
Figure 3:
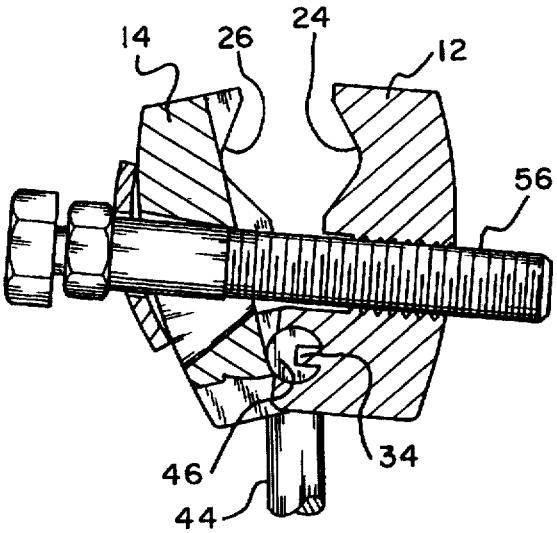
FIG. 3 is a view similar to FIG. 2 showing the jaw members pivoted away from one another.

Referring now to the drawings in detail wherein like reference numerals have been used throughout the various figures to designate like elements, there is shown in the figures a hinged electrical connector constructed in accordance with the principles of the present invention and designated generally as 10.

Figure 4:
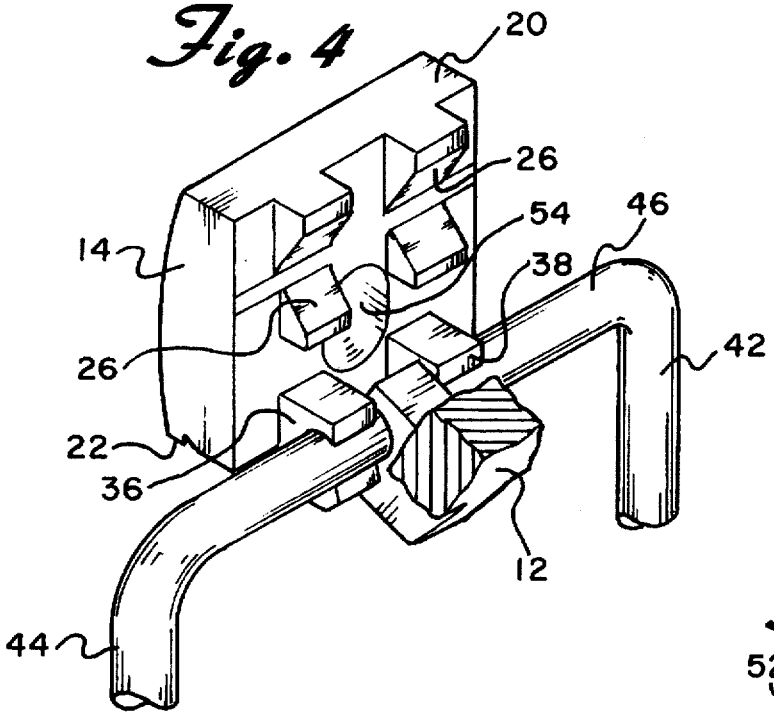
FIG. 4 is a partial side perspective view with the first jaw member cut away.
Figure 5:
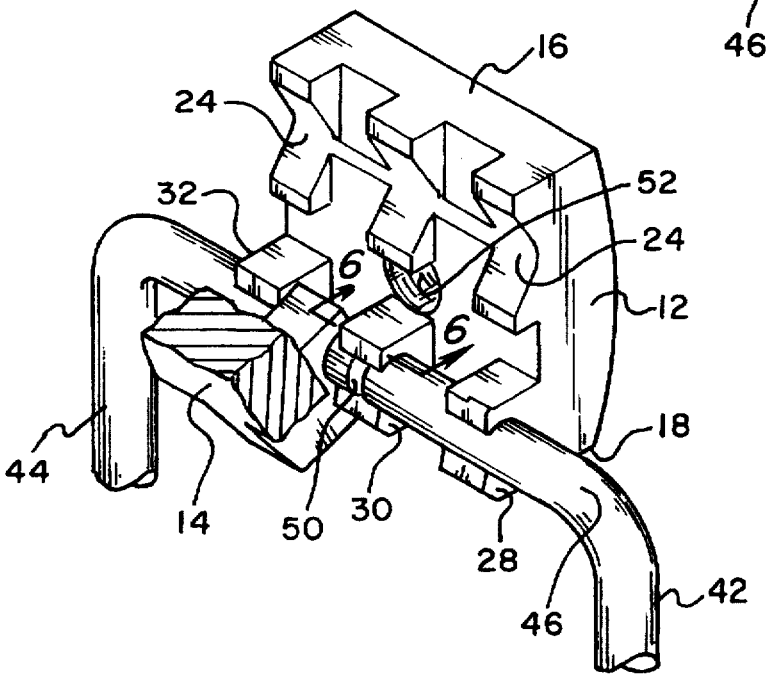
FIG. 5 is a partial side perspective view with the second jaw member cut away.

The electrical connector 10 includes first and second jaw members 12 and 14, respectively. The jaw members are preferably comprised of stainless steel. However, they can be comprised of a variety of other conductive metals and metal alloys. First jaw member 12 includes a first end 16 and a second end 18 (FIG. 5) and second jaw member 14 similarly includes a first end 20 and a second end 22 (FIG. 4). Spaced apart curved portions 24 extend inwardly from the inside surface of the first jaw member 12 adjacent the first end 16 thereof (FIG. 5). Similarly, spaced apart curved portions 26 extend inwardly from the inside surface of the second jaw member 14 adjacent the first end 20 thereof (FIG. 4).

Figure 6:
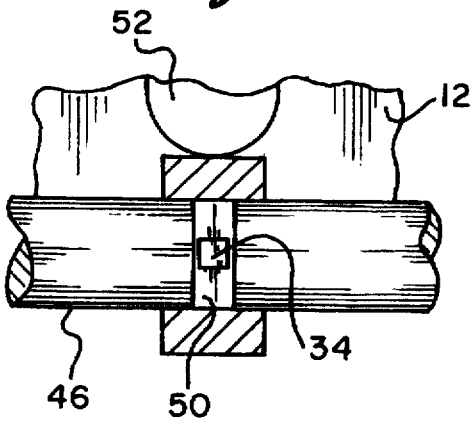
FIG. 6 is a cross-sectional view taken along lines 6—6 of FIG. 5.

Extending inwardly from the second end 18 of the first jaw member 12 are a plurality of spaced apart pairs of fingers 28, 30 and 32. In the preferred embodiment, a stop member 34 projects inwardly from the center of finger pair 30 as illustrated in FIG. 6. Similarly, spaced apart finger pairs 36 and 38 extend inwardly from the second end 22 of the second jaw member 14.

Referring to FIG. 1, a stirrup 40 in the form of a substantially closed loop is shown. The stirrup 40 includes a pair of opposing sides 42 and 44 and a pair of opposing ends 46 and 48. The stirrup is secured between the jaw members 12 and 14 in the following manner. The stop member 34 of finger pair 30 is positioned through a gap 50 formed in end 46 of the stirrup 40 (FIG. 6). Finger pair 36 of the second jaw member 14 is then positioned between finger pairs 28 and 30 of the first jaw member 12. Similarly, finger pair 38 is positioned between finger pairs 30 and 32. Accordingly, the end 46 of the stirrup is correspondingly nested in the finger pairs 28, 30 and 32 so that the sides 42 and 44 of the stirrup extend outwardly from the connector 10. In the preferred embodiment, each of the spaced apart finger pairs 28, 30 and 32 extends more than 180° around the end 46 of the stirrup 40.

The free ends of the finger pairs 28, 30, 32, 36 and 38 are then swaged together thereby causing the hinged securement of the jaw members 12 and 14 with the stirrup serving as a pintle. The stop member 34 secures the stirrup 40 in place so that axial movement is prevented.

In the preferred embodiment, a threaded hole 52 is formed through the center of the first jaw member 12 (FIGS. 5 and 6). An elongated bolt hole 54 is formed through the center of the second jaw member 14 (FIG. 4). The elongated bolt hole 54 is preferably flared outward from the inside surface of the second jaw member 14 to the outside surface thereof. A shear head bolt 56 is adapted to be positioned through the elongated bolt hole 54 and threadably engaged in the threaded hole 52. The elongated hole 54, formed in the second jaw member 14, is significantly larger than the diameter of the bolt 56.

In order to facilitate an understanding of the principles associated with the foregoing apparatus, its operation will now be briefly described. The first ends 16 and 20 of the jaw members 12 and 14 are separated from one another a sufficient distance to allow a conductor 58, such as a high tension wire, to fit therebetween. Since the elongated hole 54 formed in the second jaw member 14 is significantly larger than the diameter of the bolt 56, the first end of the jaw member 14 can be separated a significant distance from the first end of the jaw member 12 while one end of the bolt 56 remains threaded through the bolt hole 52 in the first jaw member 12. This permits the electrical connector to be secured to a high tension wire that has a relatively large diameter. Thereafter, the hinged electrical connector 10 is positioned adjacent the high tension wire (see FIG. 1). The high tension wire 58 is then placed between spaced apart curved portions 24 and 26 on the first and second jaw members 12 and 14, respectively. The high tension wire is firmly secured to the hinged electrical connector 10 by threading the bolt 56 further into threaded hole 52 thereby causing the first ends 16 and 20 of the first and second jaw members to converge toward one another and be firmly clamped onto the high tension wire.

The connector 10 is secured to the high tension wire so that energy from the wire can be tapped from the same and delivered to another an electrical device such as a transformer. More specifically, the stirrup 40 serves as a terminal through which electricity can be trapped. A lead or tap line (not shown) can have one end clamped to the stirrup and another end secured to the electrical device so that electricity can be provided to the device.

The present invention may be embodied in other specific forms without departing from the spirit or essential attributes thereof and accordingly reference should be made to the appended claims rather than to the foregoing specification as indicating the scope of the invention.

What is claimed is:

1. An electrical connector for facilitating the connection between an energized line and a tap line comprising:

a first metal jaw member having an inside surface, an outside surface, a first end and a second end, said first jaw member having a curved portion formed on said inside surface adjacent said first end, said first jaw member further having a first hinge means positioned adjacent said second end thereof;

a second metal jaw member having an inside surface, an outside surface, a first end and a second end, said second jaw member having a curved portion formed on said inside surface adjacent said first end, said second jaw member further having a second hinge means positioned adjacent said second end thereof;

a metal stirrup secured between said first and second hinge means, said stirrup having a gap formed therein, wherein said metal stirrup is a pintle about which said first and second hinge means are swaged together so that said jaw members are hingedly connected to each other, and stop means on one of said jaw members and positioned in said gap in said stirrup for preventing lateral movement of said stirrup.

2. The electrical connector of claim 1 further including fastener means for urging said first end of said first jaw member towards said first end of said second jaw member.

3. The electrical connector of claim 2 wherein said fastener means includes a threaded hole formed through said first jaw member, a hole formed through said second jaw member and a bolt having a predetermined diameter, said bolt passing through said hole in said second jaw member and threadably engageable in said threaded hole of said first jaw member so that rotation of said bolt causes said first ends of said first and second jaw members to converge towards one another.

4. The electrical connector of claim 3 wherein said hole formed through said second Jaw member has a cross-sectional area which is substantially larger than said diameter of said bolt.

5. An electrical connector for facilitating the connection between an energized line and a tap line comprising:

a first metal jaw member having an inside surface, an outside surface, a first end and a second end, said first jaw member having a curved portion formed on said inside surface adjacent said first end, said first jaw member further having a first hinge means positioned adjacent said second end thereof and defined by a plurality of spaced apart finger pairs;

a second metal jaw member having an inside surface, an outside surface, a first end and a second end, said second jaw member having a curved portion formed on said inside surface adjacent said first end, said second jaw member further having a second hinge means positioned adjacent said second end thereof and defined by a plurality of spaced apart finger pairs, and a stirrup comprised of an elongated conductor formed into a substantially closed loop, said stirrup having a circular cross-section and having a portion nested in said spaced apart finger pairs of said first and second jaw members wherein said stirrup is a pintle about which said finger pairs are swaged together so that said jaw members are hingedly connected to each other.

6. The electrical connector of claim 5 wherein at least some of said spaced apart finger pairs of said jaw members extend around said portion of said stirrup more than 180°.

7. The electrical connector of claim 5 wherein said portion of said stirrup has a gap formed therein and wherein said electrical connector includes a stop means projecting inwardly and being positioned within said gap for preventing axial movement of said stirrup along said electrical connector.

8. The electrical connector of claim 7 further including fastener means for urging said first end of said first jaw member towards said first end of said second jaw member.

9. The electrical connector of claim 8 wherein said fastener means includes a threaded hole formed through said first jaw member, a hole formed through said second jaw member and a bolt having a predetermined diameter, said bolt extending through said hole in said second jaw member and being threadably engagable in said threaded hole of said first jaw member so that rotation of said bolt causes said first ends of said first and second jaw members to converge towards one another.

10. The electrical connector of claim 9 wherein said hole formed through said second jaw member has a cross-sectional area which is substantially larger than said diameter of said bolt.

* * * * *